United States Patent [19]

Toivanen

[11] Patent Number: 5,068,023

[45] Date of Patent: Nov. 26, 1991

[54] ELECTRODE ARRANGEMENT

[76] Inventor: Tapio Toivanen, Kouhialankatu 50, SF-50100 Mikkeli, Finland

[21] Appl. No.: 641,636

[22] Filed: Jan. 17, 1991

Related U.S. Application Data

[63] Continuation of Ser. No. 326,547, Feb. 21, 1989, abandoned.

[30] Foreign Application Priority Data

Jun. 24, 1987 [FI] Finland ..... 872811

[51] Int. Cl.[5] ..... C23F 13/00

[52] U.S. Cl. ..... 204/196; 162/1; 162/232; 204/147

[58] Field of Search ..... 204/147, 148, 196, 197

[56] References Cited

U.S. PATENT DOCUMENTS

| | | | |
|---|---|---|---|
| 1,608,709 | 11/1926 | Mills | 204/197 |
| 1,705,197 | 3/1929 | Mills | 204/197 |
| 3,108,055 | 10/1963 | Grant | 204/197 |
| 3,166,487 | 1/1965 | Owren | 204/197 |
| 3,350,288 | 10/1967 | Almar-Naess | 204/196 |
| 3,476,673 | 11/1969 | Stiles | 204/196 |
| 3,868,313 | 2/1975 | Gay | 204/196 |
| 3,953,311 | 4/1976 | Wasson | 204/197 |
| 4,285,787 | 8/1981 | Garner et al. | 204/147 |
| 4,457,821 | 7/1984 | Sudrabin et al. | 204/197 |
| 4,502,929 | 3/1985 | Stewart et al. | 204/294 |

*Primary Examiner*—T. Tung

*Attorney, Agent, or Firm*—Andrus, Sceales, Starke & Sawall

[57] ABSTRACT

In the cathodic protection of a metal suction roll having a cylindrical shell with a plurality of holes extending therethrough, an insulating sleeve disposed in each hole and an anode disposed in each sleeve.

3 Claims, 1 Drawing Sheet

ELECTRODE ARRANGEMENT

This is a continuation of application Ser. No. 07/326,547, filed Feb. 21, 1989 now abandoned.

The present invention concerns an electrode arrangement for cathodic protection of the metallic body part of a rotating perforated roll, said arrangement comprising an anode and an electrolyte which is in contact with the metallic body part of the roll that is to be protected and with the anode, the body part of the roll which is to be protected being connected to the cathode.

BACKGROUND OF THE INVENTION

Electrochemical protection of the recesses, narrow slits, small diameter and/or deep holes, grooves, pipes, corners and equivalent of perforated rolls against corrosion, e.g. cathodic protection, is cumbersome, expensive and frequently technically impossible by methods in present use, because usually the protective electric current cannot be directed on those points of the structure which are critical in view of corrosion or soiling. The objects which are particularly embarrassing from the viewpoint of corrosion control or soiling are rotating perforated rolls, e.g. the shell, or body part, of a paper machine suction roll, or a drum in a bleaching filter in a pulp mill.

In the thick-walled shell of a suction roll a great number of small diameter, long holes have been drilled. Unsatisfactory durability of the shell which is perforated and serves in chemically corrosive conditions, and which is physically subjected to heavy load, so-called pinpoint corrosion, stress/fatigue corrosion fractures and soiling have since decades been among the worst problems faced by paper machine manufacturers and papermakers. Although there has been development of the shell materials in recent years, the conditions giving rise to suction roll corrosion have become worse, and soiling has increased, in the first place owing to higher degree of closed water circulation. The heavy, fatiguing load has also increased as the machines have increased in width and the running speeds have gone up. New shell metals which present greater durability than before, for instance two-phase steels, evoke problems because they often carry residual stresses from the manufacturing process, because their drilling is difficult and because they command a high price. Fractures of this new roll type have in fact occurred after unexpectedly short service periods.

Electrochemical anticorrosive protection, by presently employed methods, of perforated rolls in pulp mills, that is, of filter drums, is not fully satisfactory because the electric current cannot be directed on the inner surfaces of the perforated shell, on recesses inside the drum, etc. when stationary electrodes outside the drum are used. Existing procedures also fail to afford satisfactory protection of those parts of the outer drum surface which at any given time are positioned outside and/or above the filtrate in the basin, that is, of the electrolyte, and are in contact with the corrosive pulp slurry; in corrosion trials under laboratory conditions, for instance, electrochemical protection is 100% effective and in plant conditions, 60 to 80% effective, depending on the steel.

A suction roll operates in that water is being drawn from the side of the outer shell periphery, from the paper web, through the holes in the shell and into a suction box on the side of the inner shell periphery. In modern fast paper machines little, if any, water passes through the holes into the suction box, owing to high peripheral velocity: the holes are rather filled when opposite the suction box, and after passing the suction box the water flies out from the holes, by centrifugal effect, to the ambience outside the shell. The region which is problematic regarding corrosion and soiling lies within the holes. Existing technology is unable to protect the surface inside the holes by electrochemical means against corrosion or soiling because electric current cannot be induced to flow in the critical region inside the holes at any high enough current density. In systems conforming to existing technology, the stationary current electrodes, e.g. anodes, have to be disposed outside the rotating shell, where they are susceptible to damage and where they may cause damage when they get loose and end up in the press nip. Furthermore, the density of protective current supplied from outside the shell is not sufficient with a view to cathodic protection.

It is a further fact that since in fast paper machines in practice no water at all passes through the holes in the suction roll, supplying electric current from inside the suction roll shell to the shell with the aid of the water drained from the paper web is an impossibility. One might contemplate the supplying of water, i.e., of electrolyte, on the inner surface, but because of the high peripheral velocity of the shell and the large aggregate hole area the quantity of such water would be excessive, inhibiting the normal operation of the roll. Attempts to supply water from the outer periphery side of the shell are often impeded by the roll coating.

SUMMARY OF THE INVENTION

The object of the present invention is to eliminate the drawbacks mentioned and to further develop the electrochemical protection of suction rolls or equivalent rolls or drums against corrosion and soiling.

The object of the invention is, in particular, to further develop the cathodic protection of the metallic body part of a perforated roll in such manner that the protection will be more efficient than before and the corrosion of the perforated roll will be less than before.

It is a further object of the invention to provide a new kind of electrode connected to a web, wire, felt or roll which is not subject to wear as much as before; which causes no abrasion or damage of the web, wire, felt or the roll which is being protected; which can be placed on the press nip without adding to the risk of damage to rolls or to the paper machine; which requires no lubricating water, i.e., electrolyte, for its operation; and which provides good electrical contact between the electrode and the electrolyte.

It is possible with the aid of the invention to counteract efficiently hidden corrosion, pinpoint corrosion and/or stress/fatigue corrosion on the interior surfaces of the holes in a rotating perforated roll, by utilizing the water, that is, electrolyte, entering the holes from the paper web.

Soiling and plugging of the holes not only increases the corrosion attack but also impairs the operation of the suction roll and has a detrimental effect on the paper quality.

In this disclosure, a perforated roll is understood to be a mainly cylindrical roll or drum having on its cylinder surface, i.e. on the shell surface, holes or apertures; particularly perforated rolls which are used in the paper, cardboard, pulp and/or groundwood industry, for instance suction rolls, suction cylinders, filter drums, etc.

The invention is based on the fundamental idea that on the interior surface of the hole in the perforated roll has been placed an anode, insulated from the roll body. The insulator placed in the hole is, for instance, tubular and it has been disposed advantageously to protect the inner surface of the hole. The electrode may be tubular as well, but it may also for instance be shaped like a ribbon, a helix, or on the whole any arbitrary shape.

Thanks to the invention, the perforated roll is cleaned better than before, which promotes the escape of water e.g. from a paper machine suction roll, thereby further improving the paper quality; similar improvement of the operating conditions is also observable when the perforated roll constitutes a filter drum in a bleaching process, for instance.

When a particular electrode roll is used, e.g. as anode or cathode, or as reference electrode, the wear of the roll will be extremely minimal; when the electrode roll is made to rotate at a speed consistent with the propagation of the web, the wear of the roll will be substantially nil.

It is furthermore possible to connect the electrode roll integrally with the web for better conduction of electricity.

Furthermore, the electrode roll requires no water lubrication.

Furthermore, when an electrode roll is used the electric contact between the web, wire or felt and the electrode roll will be excellent the contact may be enhanced by applying pressure, e.g. by conducting the web through a press nip defined by the electrode roll. The roll which is to be protected may be pressed against the electrode roll in order to obtain good contact between them.

Furthermore, when an electrode roll is used the voltage drop across the web, wire or felt and the electrode roll will be low.

Furthermore, the electrode roll may constitute the surface of the roll to be protected, in which case there is no web, wire or felt between the roll to be protected and the electrode roll.

DESCRIPTION OF THE DRAWINGS

The invention is described in detail in the following, with the aid of embodiment examples and referring to the attached drawings, wherein.

DESCRIPTION OF THE ILLUSTRATED EMBODIMENT

Figure 1:
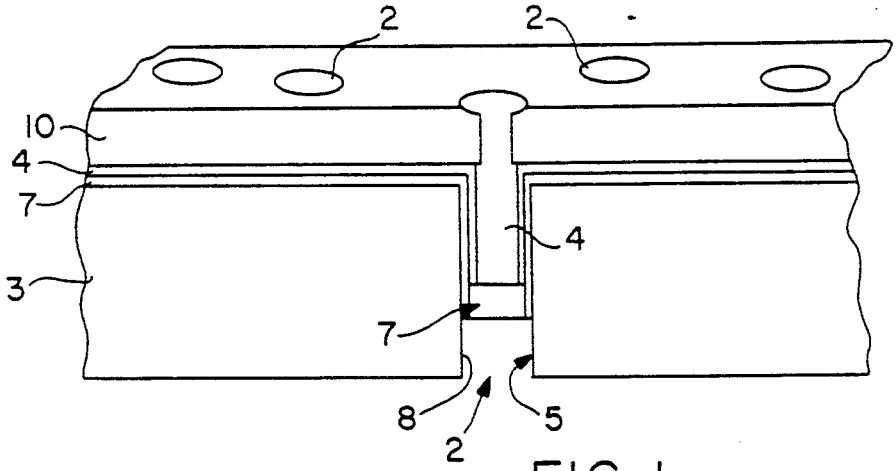
FIG. 1 presents in elevational view, and sectioned, the shell of a perforated roll according to the invention.

In FIG. 1 is seen the shell surface of a perforated roll 1 according to the invention, sectioned and in elevational view. The body part 3 of the perforated roll 1, i.e., the shell surface, consists of metal, e.g. of steel. In the body part 3, holes 2 have been drilled. On the inner surface 5 of the hole 2 has been disposed an insulator 7, which protects the outermost portion of the hole, e.g. 10–90% of the length of the hole, as seen from the outside. In the hole 2 has further been placed an electrode, constituting an anode 4, which is insulated against the body part 3 by the insulator 7. In the embodiment here depicted, the insulator as well as the anode are tubular, and they have been set tight against the hole, the insulator on the outside and the electrode on the inside, likewise tight against the insulator.

The body part 3 of the perforated roll 1 has been connected to a negative current source, and the electrodes placed in the holes 2 are connected to a positive current source. When electrolyte enters the hole 2, electric current is enabled to pass from the anode to the cathode at the unprotected portion 8 of the hole, thereby providing efficient cathodic protection of the perforated roll and, especially, of the holes.

In the embodiment depicted in FIG. 1, the insulator 7 forms in the body part 3 of the perforated roll a coating which covers and protects the shell surface. The electrode 4, that is the anode, consists of metal and forms a coating encircling the body part of the perforated roll, applied upon the insulating material 7. The perforated roll is in addition coated with a polyurethane layer 10, through which the holes 2 penetrate.

Figure 2:
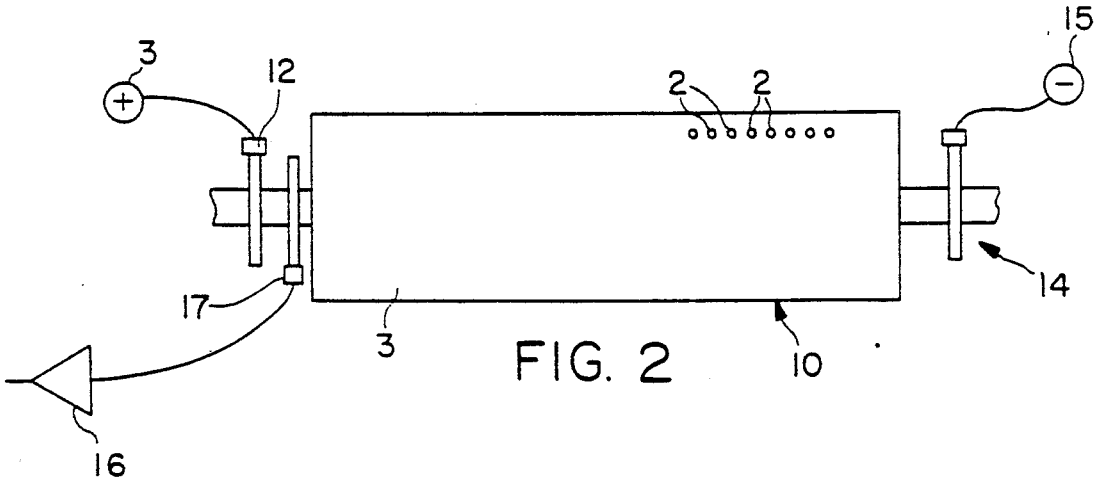
FIG. 2 presents an electrode arrangement according to the invention, applied on a perforated roll, and in schematical presentation.

In FIG. 2 is seen a perforated roll which is, in principle, of the type of the roll in FIG. 1, in elevational view and schematically presented. The surface of the perforated roll is perforated, the holes 2 have been partly coated with insulating material, electrodes have been placed in the holes, and the roll has been coated similarly as shown in FIG. 1. The electrodes placed in the holes 2 have been connected by the aid of a brush means 12, to the positive terminal 13 of a current source. The body part 3, made of steel, of the perforated roll 1 has been connected with the aid of a brush means 14, with the negative terminal. Hereby, the metallic surface of the holes 2 in the body part, that is the shell, will be negatively polarized for cathodic protection of the body part of the roll. The figure also shows a reference electrode 16, which has been connected with the aid of a brush means 17, for purposes of measurement.

The embodiment examples are only meant to illustrate the invention, without confining it in any way whatsoever.

I claim:

1. A cathodically protected rotatable suction roll, comprising a metal suction roll having a cylindrical shell formed with a plurality of holes extending through the shell, an annular layer of insulation disposed on the outer surface of said roll, a layer of anodic metal disposed on the layer of insulation, said holes being exposed through said layers, an electrically insulating sleeve disposed in each hole in contact with the portion of the shell bordering the hole, each sleeve extending only a portion of the length of the hole, and an anode disposed in each sleeve and disposed out of direct electrical contact with said cylindrical shell, said anodes being connected to said layer of anodic metal, and means for connecting said layer of anodic metal in an electrical circuit with said cylindrical shell, electrolyte passing through said holes acting to complete an electrochemical circuit to thereby protect the portions of the shell bordering said holes from corrosion.

2. The system of claim 1, wherein each insulating sleeve extends from 10% to 90% of the length of the respective hole.

3. The system of claim 1, wherein each anode has a shorter length than the respective insulating sleeve.

* * * * *